US008836233B2

(12) United States Patent
Chung et al.

(10) Patent No.: US 8,836,233 B2
(45) Date of Patent: Sep. 16, 2014

(54) LIGHT SOURCE APPARATUS AND DRIVING APPARATUS THEREOF

(75) Inventors: Lung-Pin Chung, Miaoli County (TW); Jui-Feng Huang, Hsinchu (TW); Chun-Chuan Lin, Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 468 days.

(21) Appl. No.: 13/335,978

(22) Filed: Dec. 23, 2011

(65) Prior Publication Data

US 2013/0119877 A1 May 16, 2013

(30) Foreign Application Priority Data

Nov. 15, 2011 (TW) ..... 100141600 A

(51) Int. Cl.
*H05B 33/08* (2006.01)

(52) U.S. Cl.
CPC ..... *H05B 33/0818* (2013.01)
USPC ..... 315/291; 315/224; 315/307

(58) Field of Classification Search
USPC ..... 315/307, 308, 291, 224
See application file for complete search history.

(56) References Cited

U.S. PATENT DOCUMENTS

| | | | | |
|---|---|---|---|---|
| 7,579,818 | B2 | 8/2009 | Ball et al. | |
| 7,750,616 | B2 | 7/2010 | Liu | |
| 7,888,888 | B2 | 2/2011 | Huang et al. | |
| 8,274,231 | B2 * | 9/2012 | Yang | 315/185 R |
| 2008/0012502 | A1 | 1/2008 | Lys | |
| 2012/0181950 | A1 * | 7/2012 | Yu et al. | 315/294 |
| 2012/0299500 | A1 * | 11/2012 | Sadwick et al. | 315/224 |

FOREIGN PATENT DOCUMENTS

| | | |
|---|---|---|
| JP | 4688905 | 2/2011 |
| TW | 200641746 | 12/2006 |
| TW | M357021 | 5/2009 |
| TW | M413298 | 10/2011 |

OTHER PUBLICATIONS

"Office Action of Taiwan Counterpart Application", issued on Jan. 20, 2014, p. 1-p. 16, in which the listed references were cited.

Li et al., "A Novel Single-Stage High-Power-Factor AC-to-DC LED Driving Circuit with Leakage Inductance Energy Recycling", Industrial Electronics, IEEE Transactions on, May 5, 2011, pp. 1~5.

(Continued)

*Primary Examiner* — David H Vu
(74) *Attorney, Agent, or Firm* — Jianq Chyun IP Office

(57) ABSTRACT

A light source driving apparatus including a voltage converting unit, a switching unit, a feedback unit and a control unit is provided. The voltage converting unit provides a driving current to drive a light source module. The switching unit is controlled to be conducted or not by a switch signal. The feedback unit detects a load status of the light source module, and provides a feedback signal accordingly. The control unit modulates pulse widths of the switch signal according to the feedback signal, a signal upper limitation, and a signal lower limitation, so as to control the switching unit to be conducted. The voltage converting unit includes an energy storage element. When the switching unit is conducted, the energy storage element stores a part of energy provided by the input power source. When the switching unit is not conducted, the energy storage element provides the driving current.

28 Claims, 5 Drawing Sheets

(56) References Cited

OTHER PUBLICATIONS

Aguilar et al., "LED Driver Circuit with Inherent PFC", Applied Power Electronics Conference and Exposition (APEC), 2010 Twenty-Fifth Annual IEEE, Feb. 21, 2010, pp. 605~610.
Jianwen Shao, "Single Stage Offline LED Driver", Applied Power Electronics Conference and Exposition, 2009. APEC 2009. Twenty-Fourth Annual IEEE, Feb. 15, 2009, pp. 582~586.
Yang et al., "Variable On-Time Controlled ZVS Buck PFC Converter for HB-LED Application", Applied Power Electronics Conference and Exposition (APEC), 2011 Twenty-Sixth Annual IEEE, Mar. 6, 2011, pp. 65~70.
Hwu et al., "A High Brightness Light-Emitting Diode Driver with Power Factor and Total Harmonic Distortion Improved", Applied Power Electronics Conference and Exposition (APEC), 2011 Twenty-Sixth Annual IEEE, Mar. 6, 2011, pp. 713~717.

* cited by examiner

LIGHT SOURCE APPARATUS AND DRIVING APPARATUS THEREOF

CROSS-REFERENCE TO RELATED APPLICATION

This application claims the priority benefit of Taiwan application serial no. 100141600, filed on Nov. 15, 2011. The entirety of the above-mentioned patent application is hereby incorporated by reference herein and made a part of this specification.

BACKGROUND

1. Technical Field

The disclosure relates to an electronic apparatus and a driving apparatus thereof, and more particularly, to a light source apparatus and a driving apparatus thereof.

2. Related Art

Recently, light emitting diodes (LEDs) have increasingly broad application in lighting, and designs thereof on lamps tend to close to use experiences of conventional lamps. For example, an LED light source capable of directly replacing a conventional bulb without being additionally connected to a transformer is a representative example. However, a driving circuit of the LED light source just minimizes the transformer. Therefore, how to reduce the volume of the LED light source by using a simple control system and further reduce the cost of the driving circuit becomes a project to be solved.

In the prior art, the LED light source is driven by a buck circuit structure operated in a continuous conduction mode (CCM), and the structure is applied in an alternative current (AC) system. In a most common method, after an AC power source is full-wave rectified, an AC voltage is rectified with a large capacitor to a voltage source approximate to DC, so as to be provided to the buck structure for performing voltage conversion. However, in this method, due to the rectification performed by the large capacitor, a current phase severely lags behind a voltage phase, and the lag of the current phase may cause a low factor of success rate.

In order to eliminate the defects of the conventional method, various driving circuit structures have mushroomed enormously. In many prior arts, the system can be mainlined in the CCM only through precise calculation, or the system lacks an energy storage element to perform buffer and energy storage so that a part of energy is wasted on internal resistance of the circuit.

Therefore, it is required to provide a high-efficiency and stable light source driving apparatus.

SUMMARY

A light source driving apparatus is introduced herein, which is capable of increasing conversion efficiency of a light source apparatus, and providing a stable driving current.

A light source apparatus is introduced herein, which uses the foregoing light source driving apparatus, and is capable of increasing conversion efficiency thereof, and having a stable driving current.

A light source driving apparatus is provided, which is suitable for driving at least one light source module. The light source driving apparatus includes a voltage converting unit, a switching unit, a feedback unit and a control unit. The voltage converting unit is coupled to an input power source, and provides a driving current to drive a light source module. The switching unit is coupled to the voltage converting unit, and controlled to be conducted or not by a switch signal. The feedback unit is coupled to the light source module, detects a load status of the light source module, and provides a feedback signal. The feedback signal has a value representing the detected load status of the light source module. The control unit is coupled to the feedback unit, and modulates pulse widths of the switch signal according to the feedback signal, a signal upper limitation and a signal lower limitation, so as to control the switching unit to be conducted or not. The voltage converting unit includes an energy storage element. When the switching unit is conducted, the energy storage element stores a part of energy provided by the input power source. When the switching unit is not conducted, the energy storage element provides the driving current to drive the light source module.

A light source apparatus is provided, which includes a light source module, a voltage converting unit, a switching unit, a feedback unit and a control unit. The voltage converting unit is coupled to an input power source, and provides a driving current to drive the light source module. The switching unit is coupled to the voltage converting unit, and controlled to be conducted or not by a switch signal. The feedback unit is coupled to the light source module, detects a load status of the light source module, and provides a feedback signal. The feedback signal has a value representing the detected load status of the light source module. The control unit is coupled to the feedback unit, and modulates pulse widths of the switch signal according to the feedback signal, a signal upper limitation and a signal lower limitation, so as to control the switching unit to be conducted or not. The voltage converting unit includes an energy storage element. When the switching unit is conducted, the energy storage element stores a part of energy provided by the input power source. When the switching unit is not conducted, the energy storage element provides the driving current to drive the light source module.

Based on the foregoing description, in the exemplary embodiments, the control unit determines the current load status of the light source module according to the signal detected by the feedback unit, and compares the signal with the preset signal upper and lower limitations, so as to serve as a reference for controlling the switching unit. A driving power source required by the light source apparatus is provided by adjusting the action of the switching unit.

Several exemplary embodiments accompanied with figures are described in detail below to further describe the disclosure in details.

BRIEF DESCRIPTION OF THE DRAWINGS

The accompanying drawings are included to provide further understanding, and are incorporated in and constitute a part of this specification. The drawings illustrate exemplary embodiments and, together with the description, serve to explain the principles of the disclosure.

DETAILED DESCRIPTION OF DISCLOSED EMBODIMENTS

In an exemplary embodiment, a switching unit is regulated in time by observing a status of a load (for example, a current) flowing through a light source module, on one hand, it may avoid an overlarge current to flow through the light source module to cause damages, and on the other hand, when the current of the light source module is insufficient, the current required for driving the light source module may be provided timely. Furthermore, the regulation is performed by detecting a feedback signal, so the driving apparatus according to the exemplary embodiment does not need to generate a fixed working frequency to serve as a switching basis of the switch. Moreover, the switching of the switch is on the basis of the current flowing through the light source module, and therefore, a stable driving current may be further provided to the light source module. Several exemplary embodiments are illustrated in detail with accompanying drawings below.

Figure 1:
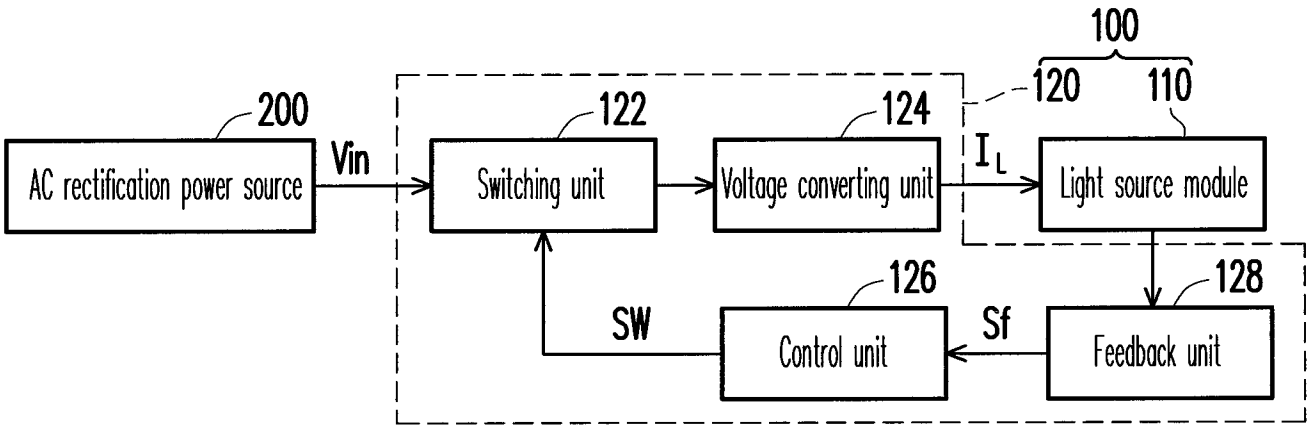
FIG. 1 is a schematic block diagram of a light source apparatus and a driving apparatus thereof according to an exemplary embodiment.

FIG. 1 is a schematic block diagram of a light source apparatus and a driving apparatus thereof according to an exemplary embodiment. Referring to FIG. 1, a light source apparatus 100 according to the embodiment includes a light source module 110 and a light source driving apparatus 120. The light source module 110 is, for example, an LED series, a plurality of groups of LED series or bulb series connected in parallel. In the following embodiment, a single LED serves as an exemplary embodiment of the light source module 110, but it is not limited in the embodiment.

In this embodiment, the light source driving apparatus 120 is suitable for driving at least one light source module 110 as shown in FIG. 1. The light source driving apparatus 120 includes a voltage converting unit 124, a switching unit 122, a feedback unit 128 and a control unit 126.

The voltage converting unit 124 is coupled to an AC rectification power source 200 through the switching unit 122, and provides an input power source Vin to the light source driving apparatus 120. The voltage converting unit 124 provides a driving current $I_L$ to drive the light source module 110 according to the input power source Vin. The AC rectification power source 200 is used for providing the power required by the light source apparatus 100 when operating.

The switching unit 122 is coupled between the AC rectification power source 200 and the voltage converting unit 124, and controlled to be conducted or not by a switch signal SW generated by the control unit 126. According to different implementation manners of an internal circuit of the switching unit 122, for example, a PMOS transistor or an NMOS transistor, the switching unit 122 determines to be conducted or not respectively in response to the switch signal SW in a high level or a low level. In this embodiment, the voltage converting unit 124 includes an energy storage element (not shown). When the switching unit 122 is conducted, the energy storage element stores a part of energy provided by the input power source Vin, and a form of the stored energy includes electric energy or magnetic energy, depending on whether the energy storage element is implemented by a capacitor or an inductor. In addition, when the switching unit 122 is not conducted, the driving current $I_L$ is provided by the energy storage element, so as to drive the light source module 110, which will be illustrated later.

The feedback unit 128 is coupled to the light source module 110, for detecting a load status (for example, a magnitude of a current of the light source module 110) of the light source module 110, so as to provide a feedback signal Sf to the control unit 126. Therefore, the feedback signal has a value representing the detected load status of the light source module 110. Moreover, if the load status is detected, a feedback signal Sf corresponding to the detection result is output to the control unit 126.

The control unit 126 is coupled to the feedback unit 128 and receives the feedback signal Sf. The control unit 126 modulates pulse widths of the switch signal SW according to the feedback signal Sf, a signal upper limitation Vref1, and a signal lower limitation Vref2, so as to control the switching unit 122 to be conducted or not. In this embodiment, the signal upper and lower limitations Vref1, Vref2 are, for example, voltage upper and lower limitations. For example, the control unit 126 respectively compares the signal upper limitation Vref1 and the signal lower limitation Vref2 with the feedback signal Sf, so as to serve as the basis of modulating the pulse widths of the switch signal SW. Further, the control unit 126 controls the switching unit 122 to be conducted or not by modulating the pulse widths of the switch signal SW. That is to say, the control unit 126 determines the current load status of the light source module 110 according to the signal detected by the feedback unit 128, and compares the signal with the preset signal upper and lower limitations Vref1, Vref2, so as to serve as the reference for controlling the switching unit 122. The driving power source required by the light source apparatus 100 is provided by adjusting the action of the switching unit 122.

For example, if a voltage value corresponding to the feedback signal Sf is greater than the preset signal upper limitation Vref1, the voltage of the switch signal SW is switched to a low level, so as to reduce conduction time of the switching unit 122. On the contrary, if the voltage value corresponding to the feedback signal Sf is smaller than the preset signal lower limitation Vref2, the voltage of the switch signal SW is switched to a high level, so as to increase the conduction time of the switching unit 122. Then, the control unit 126 transfers the modulated switch signal SW to the switching unit 122, so as to control a time of providing the input power source Vin to the light source apparatus 100, thereby adjusting, together with the operation of the voltage converting unit 124, the driving current $I_L$ flowing through the light source module 110 to be more stable.

In addition, in this embodiment, the input power source Vin is provided to the light source apparatus 100 through a rectifier 210 in the AC rectification power source 200, so as to supply the power required by the light source apparatus 100. Herein, the rectifier 210 is, for example, a full-wave bridge rectifier. An AC power source VAC is converted to the input power source Vin by the rectifier 210. The rectifier 210 shown in this embodiment is used to transform the AC power source VAC to a unipolar voltage, but does not filter to remove ripples of the transformed voltage. The input power source Vin still has periodical changes on the waveform thereof, and is corresponding to the frequency of the AC power source VAC.

Figure 2:
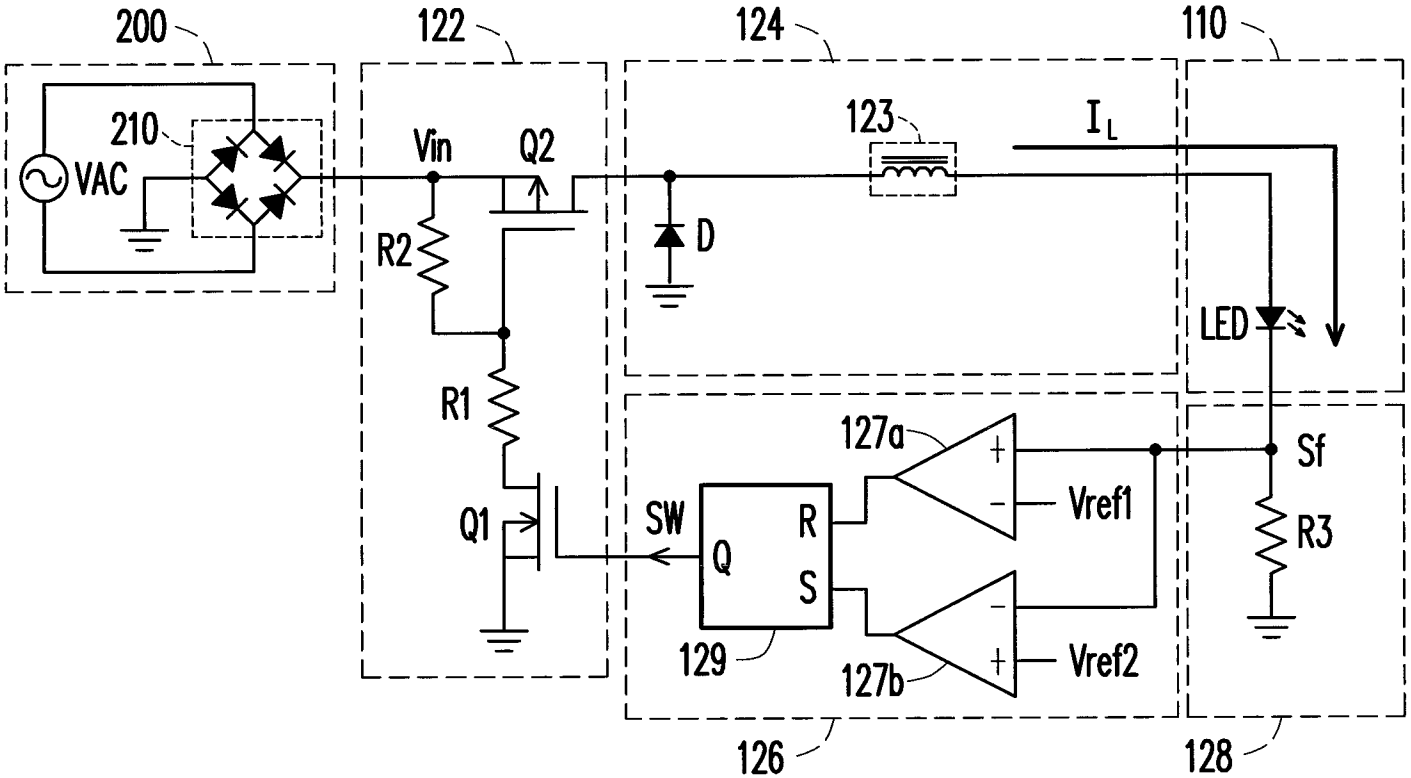
FIG. 2 is a schematic circuit diagram of the light source apparatus and the driving apparatus thereof in FIG. 1.

FIG. 2 is a schematic circuit diagram of the light source apparatus and the driving apparatus thereof in FIG. 1. Referring to FIG. 2, a light source module 110 of this embodiment takes a single LED as an example; however, the light source module 110 may be at least one of an LED series, a plurality of groups of LED series or bulb series connected in parallel.

In this embodiment, the switching unit 122 includes a first transistor Q1, a first resistor R1, a second transistor Q2 and a second resistor R2. The first transistor Q1 is, for example, a NMOS transistor, has a source coupled to ground, a gate coupled to a Q output end of an SR flip-flop of the control unit 126, and is controlled by the switch signal SW to determine whether the first transistor Q1 is conducted or not. A first end of the first resistor R1 is coupled to a drain of the first transistor Q1; and a second end is coupled to a gate of the second transistor Q2. The second transistor Q2 is, for example, a PMOS transistor, and has a source coupled to the AC rectification power source 200, for receiving the input power source Vin. A drain of the second transistor is coupled to the voltage converting unit 124, the gate thereof is coupled to the second end of the first resistor R1, and is controlled by a voltage of the second end of the first resistor R1 to determine whether the second transistor Q2 is conducted or not. A first end of the second resistor R2 is coupled to the second end of the first resistor R1, and a second end of the second resistor R2 is coupled to the source of the second transistor Q2 and the AC rectification power source 200.

The high level switch signal SW may conduct the first transistor Q1, so that the first end of the first resistor R1 is coupled to the ground, and at this time, a voltage division of the input power source Vin at the second end of the first resistor R1 may conduct the second transistor Q2, so that the input power source Vin is transmitted to the voltage converting unit 124. On the contrary, the low level switch signal SW cannot conduct the first transistor Q1, so that the switching unit 122 is entirely switched off, and at this time, the input power source Vin cannot be transmitted to the voltage converting unit 124.

In this embodiment, the voltage converting unit 124 includes a diode D and an energy storage element 123. An anode of the diode D is coupled to the ground, and a cathode thereof is coupled to the source of the second transistor Q2 in the switching unit 122. Herein, the energy storage element 123 is implemented by, for example, an inductor, which is coupled to the diode D and the light source module 110 in series. A first end of the energy storage element 123 is coupled to the source of the second transistor Q2 and the cathode of the diode D, and a second end thereof is coupled to the light source module 110. The energy storage element 123 may also be implemented by a capacitor, and at this time, an internal circuit structure of the voltage converting unit 124 should be adjusted according to actual design requirements. In this embodiment, the light source driving apparatus 120 has the voltage converting unit 124 including the inductor, so resistance consumption in the switching unit 122 is small, and may be applicable to a broad voltage range.

In addition, the configuration of the diode D may ensure that when the switching unit 122 is switched off, the driving current $I_L$ provided by the energy storage element 123 flows from the first end of the energy storage element 123 to the second end, so as to drive the light source module 110. Here, the diode D is, for example, a p-intrinsic-n (PIN) diode, which is not limited in the embodiment.

When the switching unit 122 is conducted, the input power source Vin is a main source of the driving current $I_L$, and in the process of driving the light source module 110, the energy storage element 123 stores a part of energy provided by the input power source Vin. In contrast, when the switching unit 122 is not conducted, the input power source Vin is isolated, and the energy for driving the light source module 110 is mainly provided by the energy storage element 123, that is, the energy storage element 123 provides the driving current $I_L$ to drive the light source module 110.

In this embodiment, the feedback unit 128 includes a third resistor R3, which has a first end coupled to the ground, and a second end coupled to the light source module 110 and the control unit 126. The third resistor R3 is used for detecting a load current of the light source module 110, that is, the driving current $I_L$. After the driving current $I_L$ flows through the third resistor R3, a feedback signal Sf is generated at the second end of the third resistor R3. Then, the feedback signal Sf is transmitted to the control unit 126 for comparison, so as to generate the switch signal SW. Herein, the feedback signal Sf has a voltage value representing the detected load current status of the light source module 110. In addition, the feedback unit of the embodiment is not limited to be implemented by one resistor. In other embodiments, a non-contact current sensor, for example, a hall current sensor, may also be used, which is coupled to in series to the light source module 110, for detecting the changes of the driving current $I_L$, and providing the corresponding feedback signal Sf to the control unit 126.

In this embodiment, the control unit 126 includes a first comparator 127*a*, a second comparator 127*b*, and an SR flip-flop 129. The first comparator 127*a* includes a first input end, a second input end and an output end. Herein, the first input end and the second input end are respectively a negative input end (−) and a positive input end (+). The first input end of the first comparator 127*a* is coupled to the signal upper limitation Vref1, and the second input end thereof is coupled to the feedback signal Sf.

The first comparator 127*a* is used for comparing the signal upper limitation Vref1 with the feedback signal Sf, so as to output a first comparison result, for example, 0 or 1, at the output end thereof.

The second comparator 127*b* includes a first input end, a second input end and an output end. Herein, the first input end and the second input end are respectively a negative input end (−) and a positive input end (+). The first input end of the second comparator 127*b* is coupled to the feedback signal Sf, and the second input end thereof is coupled to the signal lower limitation Vref2. The second comparator is used for comparing the signal lower limitation Vref2 with the feedback signal Sf, so as to output a second comparison result, for example, 0 or 1, at the output end thereof.

The SR flip-flop 129 includes an R input end, an S input end and a Q output end. The R input end is coupled to the output end of the first comparator 127*a*; and the S input end is coupled to the output end of the second comparator 127*b*. The SR flip-flop outputs the switch signal SW, for example, 0 or 1 respectively corresponding to a low level voltage or a high level voltage, at the output end thereof according to the first comparison result and the second comparison result, so as to switch on or off the first transistor Q1 of the switching unit 122. In this embodiment, a logic circuit for generating the switch signal SW takes the SR flip-flop as an example, and in other embodiments, according to different internal circuit designs of the control unit 126, the logic circuit for generating the switch signal SW may be implemented in different manners. For example, the control unit 126 may be a microprocessor or an integrated circuit, and the flip-flop in this embodiment is not limited to the SR flip-flop.

Figures 3A, 3B:
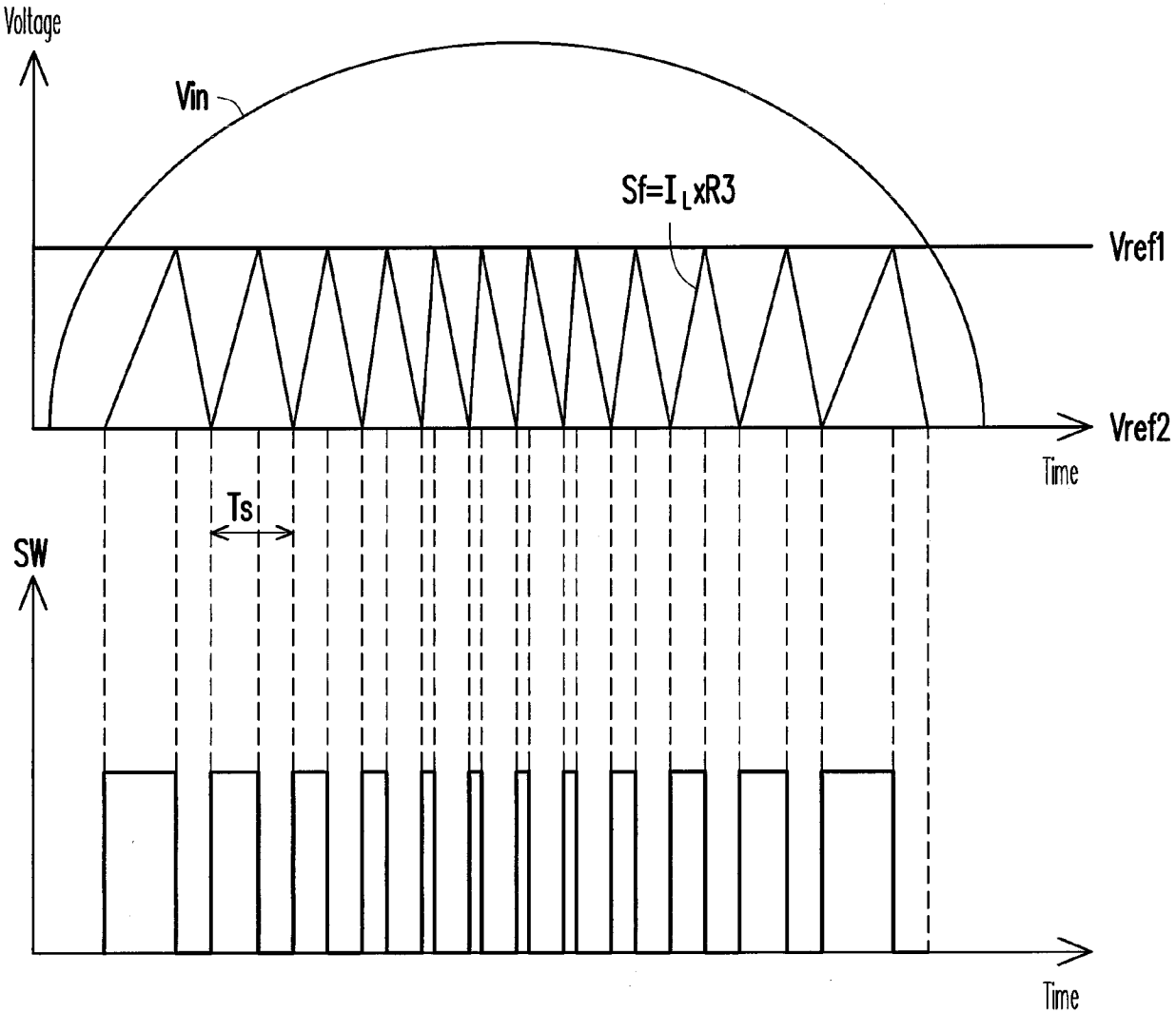
FIG. 3A is a signal waveform graph of a feedback signal Sf and an input power source Vin.
FIG. 3B is a signal waveform graph of a switch signal SW.

FIG. 3A is a signal waveform graph of a feedback signal Sf and an input power source Vin. FIG. 3B is a signal waveform graph of a switch signal SW. Referring to FIG. 2 to FIG. 3B, in this embodiment, the feedback signal Sf is, for example, a node voltage $I_L \times R3$ of the second end of the third resistor R3. The first comparator 127*a* of the control unit 126 compares the feedback signal Sf with the signal upper limitation Vref1, and the second comparator 127*b* compares the feedback signal Sf with the signal lower limitation Vref2.

In FIG. 3A, a signal waveform of one cycle of the input power source Vin is shown. The input power source Vin changes gradually in a string wave manner along with the increase of time. Before reaching a peak, the input power source Vin rises gradually along with the change of the time, and a voltage thereof is smaller than the peak. The change of the input power source Vin may directly cause the change of the charging time, and therefore, a cycle Ts of the feedback signal Sf in this stage reduces along with the increase of the timing. After reaching the peak, the input power source Vin drops gradually along with the change of the time. Therefore, the cycle Ts of the feedback signal Sf in this stage increases along with the increase of the timing. In other words, this embodiment utilizes the characteristic that the change of the input power source Vin influences the cycle Ts, and together with the limit of the signal upper limitation Vref1 on the feedback signal Sf, enables the system to change the cycle Ts naturally along with the input power source Vin.

Further, in FIG. 3B, when the switching unit 122 is switched on, the driving current $I_L$ rises along with the time, until the feedback signal Sf reaches the upper limitation Vref1. When the feedback signal Sf is slightly greater than the signal upper limitation Vref1, the first comparator 127*a* outputs the first comparison result being 1, and the SR flip-flop 129 outputs a low level switch signal SW, so that the whole switching unit 122 is switched off, and at this time, the input power source Vin cannot be transmitted to the voltage converting unit 124. That is to say, the control unit 126 outputs the low level switch signal SW that does not conduct the switching unit 122. When the switching unit 122 is not conducted, the energy storage element 123 releases an inductor current to serve as the driving current $I_L$ to drive the light source module 110, so as to keep that the light source module 110 has enough current to flow through, and the released driving current $I_L$ flowing through the energy storage element 123 drops slowly, until the energy storage element 123 cannot provide enough current. According to an inductor charging/discharging formula, the speed of the drop of the driving current $I_L$ is only related to the inductance, and therefore, in each cycle Ts of FIG. 3A, the slope of the drop of the feedback signal Sf is the same.

Then, as the time passes by, when the feedback signal Sf is slightly smaller than the signal lower limitation Vref2, the second comparator 127*b* outputs the second comparison result being 1, and the SR flip-flop 129 outputs the high level switch signal SW, so that the whole switching unit 122 is switched on, and at this time, the input power source Vin is transmitted to the voltage converting unit 124. That is to say, the control unit 126 outputs the high level switch signal SW that conducts the switching unit 122. At this time, the input power source Vin is the main source of the driving current $I_L$, and in the process of driving the light source module 110, the energy storage element 123 stores a part of the energy provided by the input power source Vin. In this embodiment, the setting of the signal lower limitation Vref2 needs to take the working current of the light source module 110 into consideration, and therefore, the value of the signal lower limitation Vref2 may not be 0.

From another point of view, when the value of the feedback current $I_L$ is lower than the current lower limitation, the control unit 126 switches on the switching unit 122, and enables the input power source Vin to enter the system to drive the light source module 110 and charge the energy storage element 123 of the voltage converting unit 124 at the same time. Until the value of the feedback current $I_L$ reaches the current upper limitation, the control unit 126 switches off the switching unit 122, and blocks the input power source Vin from entering the system. At this time, the energy storage element 123 releases the energy stored in advance to drive the light source module 110, until the value of the feedback current $I_L$ of the feedback unit 125 reaches the current lower limitation, thereby completing one circulation. At this time, the control unit 126 switches on the switching unit 122 again, and enables the input power source Vin to enter the system to drive the light source module 110 and charge the energy storage element 123 at the same time, thereby performing the circulation repeatedly.

It can be known from the repeatedly operated circulation that, the magnitudes of the cycles Ts in FIG. 3A may not be the same (that is, the frequency is not fixed). That is to say, this embodiment is designed based on the concept of frequency modulation, and therefore the light source driving apparatus 120 does not have a fixed working frequency. When the driving current $I_L$ rises, the switch signal SW is at a high level; and when the driving current $I_L$ drops, the switch signal SW is at a low level. Therefore, duty cycles of the switch signal SW may not be the same.

Figure 4:
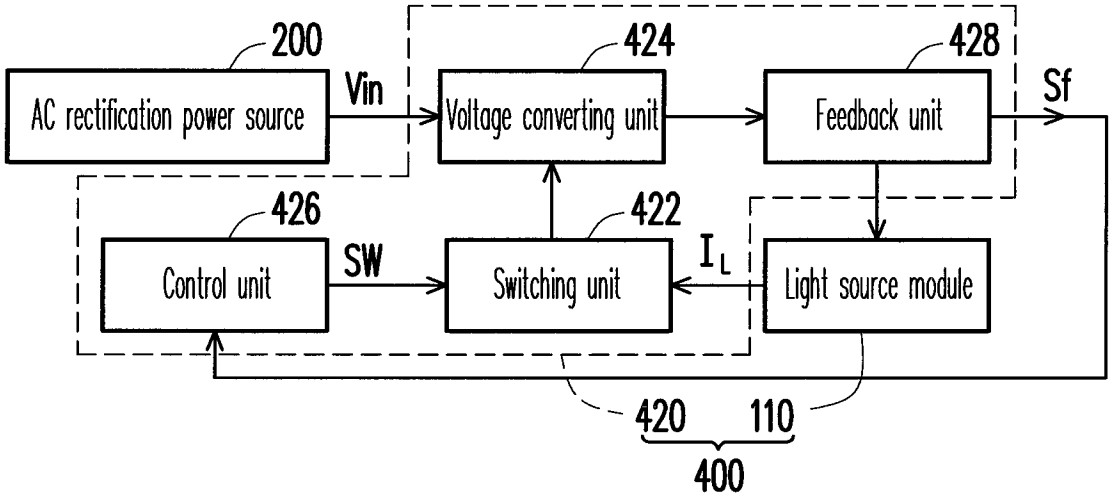
FIG. 4 is a schematic bock diagram of a light source apparatus and a driving apparatus thereof according to another exemplary embodiment.

In addition, in the exemplary embodiment, an NMOS transistor may also be implemented by the switching unit, a circuit implementation thereof is shown in FIG. 4, and a control manner thereof is similar to that described in the above embodiment. The switching on or off of the switching unit is controlled by comparing the current information detected by the feedback unit with the initially set upper and lower limitations.

FIG. 4 is a schematic block diagram of a light source apparatus and a driving apparatus according to another exemplary embodiment. Referring to FIG. 1 and FIG. 4, a light source apparatus 400 and a driving apparatus 420 of this embodiment are similar to those in FIG. 1, however, the differences mainly lie in, for example, a switching unit 422 of the light source driving apparatus 420 is implemented by an NMOS transistor, and a control manner thereof is similar to that described in the embodiment of FIG. 1.

Figure 5:
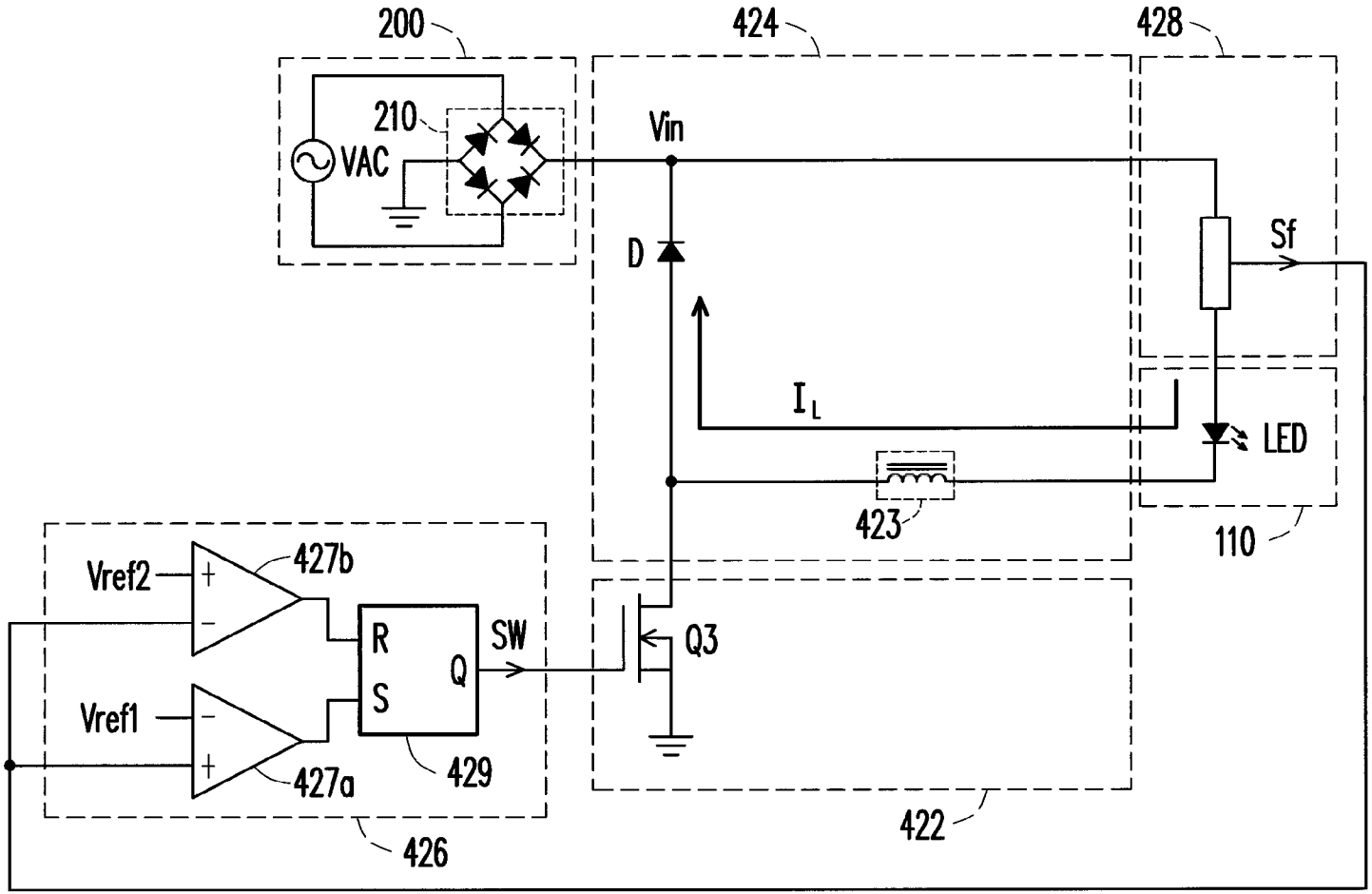
FIG. 5 is a schematic circuit diagram of the light source apparatus and the driving apparatus thereof in FIG. 4.

FIG. 5 is a schematic circuit diagram of the light source apparatus and the driving apparatus thereof in FIG. 4. Referring to FIG. 4 and FIG. 5, due to different implementation manners of the switching unit 422, the light source apparatus 400 and the driving apparatus 420 of this embodiment have a slightly different circuit structure.

In this embodiment, the switching unit 422 includes a third transistor Q3, which is an NMOS transistor. A source of the third transistor Q3 is coupled to the ground, a drain thereof is coupled to the diode D in the voltage converting unit 424 and the energy storage element 423. A gate of the third transistor Q3 is coupled to a Q output end of an SR flip-flop 429 of the control unit 426, and controlled by the switch signal SW to determine whether the third transistor Q3 is conducted or not.

The voltage converting unit 424 includes a diode D and an energy storage element 423. An anode of the diode D is coupled to the drain of the third transistor Q3, and a cathode thereof is coupled to the input power source Vin. Here, the energy storage element 423 is implemented by, for example, an inductor, which is coupled to the diode D and the light source module 110 in series. A first end of the energy storage element 423 is coupled to the light source module 110, and a second end thereof is coupled to the drain of the third transistor Q3 and the cathode of the diode D. The energy storage element 423 may also be implemented by a capacitor, and at this time, an internal circuit structure of the voltage converting unit 424 should be adjusted according to actual design requirements. In addition, the configuration of the diode D may ensure that when the switching unit 422 is switched off, the driving current $I_L$ provided by the energy storage element 423 flows from the first end of the energy storage element 423 to the second end, so as to drive the light source module 110. Here, the diode D is, for example, a PIN diode, which is not limited in the embodiment.

When the switching unit 422 is conducted, the second end of the energy storage element 423 is grounded, at this time, the input power source Vin is a main source of the driving current $I_L$, and in the process of driving the light source module 110, the energy storage element 423 stores a part of energy provided by the input power source Vin. In contrast, when the switching unit 422 is not conducted, the energy for driving the light source module 110 is mainly provided by the energy storage element 423, that is, the energy storage element 423 provides the driving current $I_L$ to drive the light source module 110.

The feedback unit 428 includes, for example, a non-contact current sensor, which is coupled to the light source module 110 in series, for sensing the change of the driving current $I_L$, and providing a corresponding feedback signal Sf to the control unit 426. The feedback unit of this embodiment is not limited to the non-contact current sensor, and may also be implemented by a combination of one or more resistors. The feedback unit 428 senses the change of the driving current $I_L$, and the feedback signal Sf generated correspondingly is transmitted to the control unit 426 for comparison, so as to generate the switch signal SW. Here, the feedback signal Sf has a voltage value representing the detected load current status of the light source module 110.

In view of the above, in the exemplary embodiments, the value of the current flowing through the light source is monitored through the information output by the feedback unit, the control unit compares the value with the signal upper and lower limitation values preset by the system, so as to determine the output status to control the switching unit, and performs real-time regulation on the switching unit. Therefore, the cycle of the switching unit changes along with the input power source, so that the system may operate stably in the CCM, thereby improving the stability of the output. Moreover, the inductor exists in the voltage converting unit of the system to perform buffer and energy storage, so few energy is consumed in the internal resistance of the switching unit.

It will be apparent to those skilled in the art that various modifications and variations can be made to the structure of the disclosed embodiments without departing from the scope or spirit of the disclosure. In view of the foregoing, it is intended that the disclosure cover modifications and variations of this disclosure provided they fall within the scope of the following claims and their equivalents.

What is claimed is:

1. A light source driving apparatus, suitable for driving at least one light source module, the light source driving apparatus comprising:

a voltage converting unit coupled to an input power source and providing a driving current to drive the light source module;

a switching unit coupled to the voltage converting unit and controlled to be conducted or not by a switch signal;

a feedback unit coupled to the light source module, detecting a load status of the light source module, and providing a feedback signal, wherein the feedback signal has a value representing the detected load status of the light source module; and a control unit coupled to the feedback unit and modulating pulse widths of the switch signal according to the feedback signal, a signal upper limitation, and a signal lower limitation, so as to control the switching unit to be conducted or not, wherein the voltage converting unit comprises an energy storage element, when the switching unit is conducted, the energy storage element stores a part of energy provided by the input power source, and when the switching unit is not conducted, the energy storage element provides the driving current to drive the light source module.

2. The light source driving apparatus according to claim 1, wherein the control unit compares the feedback signal with the signal upper limitation, and when the feedback signal is greater than the signal upper limitation, the control unit outputs the switch signal that does not conduct the switching unit.

3. The light source driving apparatus according to claim 2, wherein when the switching unit is not conducted, the driving current flowing through the energy storage element drops slowly.

4. The light source driving apparatus according to claim 2, wherein the control unit compares the feedback signal with the signal lower limitation, and when the feedback signal is smaller than the signal upper limitation, the control unit outputs the switch signal that conducts the switching unit.

5. The light source driving apparatus according to claim 4, wherein when the switching unit is conducted, the driving current flowing through the energy storage element rises accordingly.

6. The light source driving apparatus according to claim 4, wherein the control unit comprises:

a first comparator having a first input end, a second input end and an output end, wherein the first input end is coupled to the signal upper limitation, the second input end is coupled to the feedback signal, and the first comparator compares the signal upper limitation with the feedback signal, so as to output a first comparison result at the output end thereof;

a second comparator having a first input end, a second input end and an output end, wherein the first input end is coupled to the feedback signal, the second input end is coupled to the signal lower limitation, and the second comparator compares the signal lower limitation with the feedback signal, so as to output a second comparison result at the output end thereof; and a flip-flop having a first input end, a second input end and an output end, wherein the first input end is coupled to the output end of the first comparator, the second input end is coupled to the output end of the second comparator, and the flip-flop outputs the switch signal at the output end of the flip-flop according to the first comparison result and the second comparison result.

7. The light source driving apparatus according to claim 1, wherein the switching unit comprises:

a first transistor having a first end, a second end and a control end, wherein the first end of the first transistor is coupled to ground, the control end of the first transistor is coupled to the control unit, and is controlled by the switch signal to determine whether the first transistor is conducted or not;

a first resistor having a first end and a second end, wherein the first end of the first resistor is coupled to the second end of the first transistor;

a second transistor having a first end, a second end and a control end, wherein the first end of the second transistor is coupled to the input power source, the second end of the second transistor is coupled to the voltage converting unit, the control end of the second transistor is coupled to the second end of the first resistor, and controlled by a voltage of the second end of the first resistor to determine whether the second transistor is conducted or not; and a second resistor having a first end and a second end, wherein the first end of the second resistor is coupled to the second end of the first resistor, the second end of the second resistor is coupled to the first end of the second transistor.

8. The light source driving apparatus according to claim 7, wherein the voltage converting unit comprises:

a diode having an anode and a cathode, wherein the anode is coupled to the ground, the cathode is coupled to the switching unit; and an inductor serving as the energy storage element and having a first end and a second end, wherein the first end is coupled to the switching unit, the second end is coupled to the light source module, and the driving current flows from the first end of the energy storage element to the second end, so as to drive the light source module.

9. The light source driving apparatus according to claim 8, wherein the feedback unit comprises:

a third resistor having a first end and a second end, wherein the first end of the third resistor is coupled to the ground, and the second end of the third resistor is coupled to the light source module and the control unit.

10. The light source driving apparatus according to claim 1, wherein the switching unit comprises:

a third transistor having a first end, a second end and a control end, wherein the first end of the third transistor is coupled to ground, the second end of the third transistor is coupled to the voltage converting unit, and the control end of the third transistor is coupled to the control unit, and controlled by the switch signal to determine whether the third transistor is conducted or not.

11. The light source driving apparatus according to claim 10, wherein the voltage converting unit comprises:

a diode having an anode and a cathode, wherein the anode is coupled to the switching unit, and the cathode is coupled to the feedback unit; and an inductor serving as the energy storage element and having a first end and a second end, wherein the first end is coupled to the light source module, the second end is coupled to the switching unit, and the driving current flows from the first end of the energy storage element to the second end, so as to drive the light source module.

12. The light source driving apparatus according to claim 11, wherein the feedback unit comprises:

a non-contact current sensor coupled to the light source module in series and sensing changes of the driving current, so as to provide the feedback signal to the control unit.

13. The light source driving apparatus according to claim 1, wherein the light source module comprises at least one light emitting diode (LED) series.

14. The light source driving apparatus according to claim 1, wherein the input power source is an alternative current (AC) rectification power source.

15. A light source apparatus, comprising:

a light source module;

a voltage converting unit coupled to an input power source and providing a driving current to drive the light source module;

a switching unit coupled to the voltage converting unit and controlled to be conducted or not by a switch signal;

a feedback unit coupled to the light source module, detecting a load status of the light source module, and providing a feedback signal, wherein the feedback signal comprises a value representing the detected load status of the light source module; and a control unit, coupled to the feedback unit, for modulating pulse widths of the switch signal according to the feedback signal, a signal upper limitation, and a signal lower limitation, so as to control the switching unit to be conducted or not, wherein the voltage converting unit comprises an energy storage element, when the switching unit is conducted, the energy storage element stores a part of energy provided by the input power source, and when the switching unit is not conducted, the energy storage element provides the driving current to drive the light source module.

16. The light source apparatus according to claim 15, wherein the control unit compares the feedback signal with the signal upper limitation, and when the feedback signal is greater than the signal upper limitation, the control unit outputs the switch signal that does not conduct the switching unit.

17. The light source apparatus according to claim 16, wherein when the switching unit is not conducted, the driving current flowing through the energy storage element drops slowly.

18. The light source apparatus according to claim 16, wherein the control unit compares the feedback signal with the signal lower limitation, and when the feedback signal is smaller than the signal upper limitation, the control unit outputs the switch signal that conducts the switching unit.

19. The light source apparatus according to claim 18, wherein when the switching unit is conducted, the driving current flowing through the energy storage element rises accordingly.

20. The light source apparatus according to claim 18, wherein the control unit comprises:

a first comparator having a first input end, a second input end and an output end, wherein the first input end is coupled to the signal upper limitation, the second input end is coupled to the feedback signal, and the first comparator compares the signal upper limitation with the feedback signal, so as to output a first comparison result at the output end thereof;

a second comparator having a first input end, a second input end and an output end, wherein the first input end is coupled to the feedback signal, the second input end is coupled to the signal lower limitation, and the second comparator compares the signal lower limitation with the feedback signal, so as to output a second comparison result at the output end thereof; and a flip-flop having a first input end, a second input end and an output end, wherein the first input end is coupled to the output end of the first comparator, the second input end is coupled to the output end of the second comparator, and the flip-flop outputs the switch signal at the output end of the flip-flop according to the first comparison result and the second comparison result.

21. The light source apparatus according to claim 15, wherein the switching unit comprises:

a first transistor having a first end, a second end and a control end, wherein the first end of the first transistor is coupled to ground, and the control end of the first transistor is coupled to the control unit, and controlled by the switch signal to determine whether the first transistor is conducted or not;

a first resistor having a first end and a second end, wherein the first end of the first resistor is coupled to the second end of the first transistor;

a second transistor having a first end, a second end and a control end, wherein the first end of the second transistor is coupled to the input power source, the second end of the second transistor is coupled to the voltage converting unit, and the control end of the second transistor is coupled to the second end of the first resistor, and controlled by a voltage of the second end of the first resistor to determine whether the second transistor is conducted or not; and a second resistor having a first end and a second end, wherein the first end of the second resistor is coupled to the second end of the first resistor, and the second end of the second resistor is coupled to the first end of the second transistor.

22. The light source apparatus according to claim 21, wherein the voltage converting unit comprises:

a diode having an anode and a cathode, wherein the anode is coupled to the ground, and the cathode is coupled to the switching unit; and an inductor serving as the energy storage element and having a first end and a second end, wherein the first end is coupled to the switching unit, the second end is coupled to the light source module, and the driving current flows from the first end of the energy storage element to the second end, so as to drive the light source module.

23. The light source apparatus according to claim 22, wherein the feedback unit comprises:

a third resistor having a first end and a second end, wherein the first end of the third resistor is coupled to the ground, and the second end of the third resistor is coupled to the light source module and the control unit.

24. The light source apparatus according to claim 15, wherein the switching unit comprises:

a third transistor having a first end, a second end and a control end, wherein the first end of the third transistor is coupled to ground, the second end of the third transistor is coupled to the voltage converting unit, and the control end of the third transistor is coupled to the control unit, and controlled by the switch signal to determine whether the third transistor is conducted or not.

25. The light source apparatus according to claim 24, wherein the voltage converting unit comprises:

a diode having an anode and a cathode, wherein the anode is coupled to the switching unit, and the cathode is coupled to the feedback unit; and an inductor serving as the energy storage element and having a first end and a second end, wherein the first end is coupled to the light source module, the second end is coupled to the switching unit, and the driving current flows from the first end of the energy storage element to the second end, so as to drive the light source module.

26. The light source apparatus according to claim 25, wherein the feedback unit comprises:

a non-contact current sensor coupled to the light source module in series and sensing changes of the driving current, so as to provide the feedback signal to the control unit.

27. The light source apparatus according to claim 15, wherein the light source module comprises at least one light emitting diode (LED) series.

28. The light source apparatus according to claim 15, wherein the input power source is an alternative current (AC) rectification power source.

* * * * *